US008485572B2

(12) United States Patent
Nazzari

(10) Patent No.: US 8,485,572 B2
(45) Date of Patent: Jul. 16, 2013

(54) SECURITY SEAL

(75) Inventor: Ian Nazzari, Moraga, CA (US)

(73) Assignee: NIC Products Inc., Walnut Creek, CA (US)

( * ) Notice: Subject to any disclaimer, the term of this patent is extended or adjusted under 35 U.S.C. 154(b) by 0 days.

(21) Appl. No.: 12/817,254

(22) Filed: Jun. 17, 2010

(65) Prior Publication Data

US 2011/0148127 A1 Jun. 23, 2011

Related U.S. Application Data

(60) Provisional application No. 61/219,548, filed on Jun. 23, 2009.

(51) Int. Cl.
*B65D 27/30* (2006.01)
*B65D 55/06* (2006.01)

(52) U.S. Cl.
USPC ..... 292/315; 292/307 R; 292/317; 292/320

(58) Field of Classification Search
USPC ..... 292/307 R, 315, 317, 320
See application file for complete search history.

(56) References Cited

U.S. PATENT DOCUMENTS

| | | | | |
|---|---|---|---|---|
| 210,641 | A | | 12/1878 | Smith et al. |
| 998,878 | A | | 7/1911 | Dinsmoor |
| 1,059,689 | A | | 4/1913 | Webb |
| 1,132,970 | A | | 3/1915 | Peyton |
| 1,381,975 | A | | 6/1921 | Dumais |
| 1,647,398 | A | | 2/1927 | Draheim et al. |
| 1,727,754 | A | | 3/1928 | Dessauer |
| 1,863,041 | A | | 11/1928 | Dessauer |
| 1,945,965 | A | | 9/1930 | Behrman |
| 1,878,991 | A | | 9/1932 | Murray |
| 1,987,737 | A | | 7/1933 | Goddard |
| 2,020,198 | A | | 3/1934 | Miller |
| 1,982,438 | A | | 7/1934 | Keidel |
| 2,497,434 | A | | 10/1947 | Borland |
| 2,699,700 | A | | 11/1950 | Di Palma |
| 2,809,065 | A | | 7/1956 | Erke |
| 3,375,033 | A | * | 3/1968 | Moberg ..... 292/320 |
| 3,591,223 | A | | 7/1971 | Castro Neto |
| 3,736,017 | A | | 5/1973 | Kaiho |
| 3,954,294 | A | | 5/1976 | Iwamoto et al. |
| 4,106,801 | A | | 8/1978 | De Lima Castro Neto |

(Continued)

FOREIGN PATENT DOCUMENTS

| | | |
|---|---|---|
| DE | 2262421 | 7/1973 |
| GB | 2168654 A | 6/1986 |
| IT | 660127 | 1/1964 |

OTHER PUBLICATIONS

International Search Report and Written Opinion in PCT/US2010/001749, Aug. 19, 2010.

*Primary Examiner* — Carlos Lugo
(74) *Attorney, Agent, or Firm* — Workman Nydegger

(57) ABSTRACT

A security seal has an outer body, a locking insert, and a shackle. The locking insert and shackle are received within a cavity of the outer body to be locked therein. Once the locking insert is engaged with the outer body, they cannot be disengaged without showing evidence of the disengagement. The evidence of the disengagement can be in the form of damage to any component of the security seal, in the form of mismatching of marked components of the security seal, or in any other suitable form showing evidence of the disengagement.

22 Claims, 5 Drawing Sheets

U.S. PATENT DOCUMENTS

| | | | | | |
|---|---|---|---|---|---|
| 4,175,782 | A | | 11/1979 | de Lima Castro Neto | |
| 4,502,305 | A | | 3/1985 | Bakker | |
| 4,687,240 | A | * | 8/1987 | Swift | 292/320 |
| 4,722,562 | A | | 2/1988 | Burt | |
| 4,733,893 | A | * | 3/1988 | Davis et al. | 292/320 |
| 4,736,604 | A | * | 4/1988 | Zeller et al. | 70/457 |
| 4,775,175 | A | * | 10/1988 | Swift | 292/307 R |
| 4,782,613 | A | * | 11/1988 | Guiler et al. | 40/316 |
| 4,793,641 | A | | 12/1988 | Sokol | |
| 4,793,644 | A | * | 12/1988 | Swift | 292/320 |
| 4,818,002 | A | | 4/1989 | De Lima Castro Neto | |
| 4,832,387 | A | | 5/1989 | Guiler | |
| 4,836,590 | A | * | 6/1989 | Swift | 292/320 |
| 4,887,855 | A | | 12/1989 | Tritton et al. | |
| 4,893,853 | A | * | 1/1990 | Guiler | 292/320 |
| 4,909,552 | A | * | 3/1990 | Weber et al. | 292/320 |
| 4,940,268 | A | | 7/1990 | Lesquir et al. | |
| 4,968,075 | A | | 11/1990 | Lesquir et al. | |
| 5,118,148 | A | | 6/1992 | De Lima Castro Neto | |
| 5,180,200 | A | | 1/1993 | Georgopoulos et al. | |
| 5,314,219 | A | * | 5/1994 | Georgopoulos et al. | 292/320 |
| 5,345,657 | A | | 9/1994 | Shimizu | |
| 5,348,180 | A | | 9/1994 | Shepard | |
| 5,402,958 | A | | 4/1995 | Mahaney | |
| 5,427,423 | A | | 6/1995 | Georgopoulos | |
| 5,452,930 | A | | 9/1995 | Morgan | |
| 5,489,034 | A | | 2/1996 | Netto | |
| 5,577,395 | A | | 11/1996 | Kuykendall | |
| 5,762,386 | A | | 6/1998 | Fuehrer | |
| 5,782,513 | A | | 7/1998 | Nazzari | |
| 5,788,294 | A | | 8/1998 | Leon et al. | |
| 5,871,243 | A | | 2/1999 | Wenk | |
| 6,128,932 | A | | 10/2000 | Mainetti et al. | |
| 6,283,517 | B1 | | 9/2001 | Nazzari | |
| 6,416,091 | B1 | | 7/2002 | Wenk et al. | |
| 6,966,584 | B2 | | 11/2005 | Debrody et al. | |
| 7,243,963 | B2 | | 7/2007 | De Lima Castro | |
| 7,472,933 | B2 | * | 1/2009 | Weedon et al. | 292/307 A |
| 2007/0040395 | A1 | * | 2/2007 | Lee | 292/320 |
| 2011/0210567 | A1 | | 9/2011 | Nazzari | |

* cited by examiner

SECURITY SEAL

This application claims the benefit of U.S. Provisional Application No. 61/219,548, filed Jun. 23, 2009.

FIELD OF THE INVENTION

The present invention relates generally to the field of security seals, and more specifically to a security seal that discourages tampering therewith by being configured in a manner such that any tampering therewith will be evident upon visual inspection of the security seal.

BACKGROUND

Security seals are commonly used to secure closure of utility meters, postal boxes, or other receptacles or devices where it is desired to prevent tampering therewith. Such seals may include a plastic body with a pair of apertures opening at one end of the body and a shackle formed of a piece of U-shaped wire having legs with reversibly bent end portions. When the seal is put into use, the shackle legs are first threaded through a structure to be secured, such as a retaining ring fitted around a cover for an electric meter. The shackle legs are then inserted into the body apertures whereby the reversibly bent end portions engage some form of inner structure of the body for permanent retention. A lateral pulling force on the shackle only forces the reversibly bent end portions into stronger engagement with the body. Thus, the shackle must be severed or otherwise broken, or the seal body must be damaged to open the seal.

In addition to the usual locking mechanisms, security seals typically include some form of tamper-indicating structure. Generally, tamper-indicating structures are designed such that any significant attempts to defeat or tamper with the seal will normally result in altering the seal in such a manner that the attempt will be readily detectable. For example, if any attempt to tamper with the seal is made, portions of the seal may be permanently damaged. Such damage in the seal is typically readily apparent, thereby indicating evidence of tampering.

Although such devices have served the purpose, they have not provided entirely satisfactory results, because some efforts to defeat such structures by picking have proved successful. One such method of picking involves inserting a picking tool into the seal body through openings or spaces where the shackle legs enter the seal body and deforming or cutting the shackle legs to an extent that the legs can be freely withdrawn from the sealed body, reformed, and later replaced in the seal body. Such tools also can be used to deform or cut parts of the seal body securing the shackle Other tampering methods may include dissolving the shackle wire with acid, removing the security seal to tamper with the previously sealed meter, receptacle or device, and replacing the security seal using a replacement shackle.

Embodiments of a security seal according to the present disclosure provide improved security by discouraging tampering therewith by being configured in a manner such that any tampering therewith will be evident upon visual inspection of the security seal.

SUMMARY

Embodiments of a security seal that provides improved security by discouraging tampering therewith by being configured in a manner such that any tampering therewith will be evident upon visual inspection of the security seal are disclosed herein.

The security seal generally includes a female outer body, a male locking insert configured to be engaged with the female outer body, and a shackle retained between the female outer body and the male locking insert. Once the male locking insert is engaged with the female outer body, they cannot be disengaged without showing evidence of the disengagement. The evidence of the disengagement can be in the form of damage to any component of the security seal, in the form of mismatching of marked components of the security seal, or in any other suitable form showing evidence of the disengagement.

BRIEF DESCRIPTION OF THE DRAWINGS

These and other features, aspects, and advantages of the present invention will become better understood with regard to the following description, appended claims, and accompanying drawings where:

Figure 1:
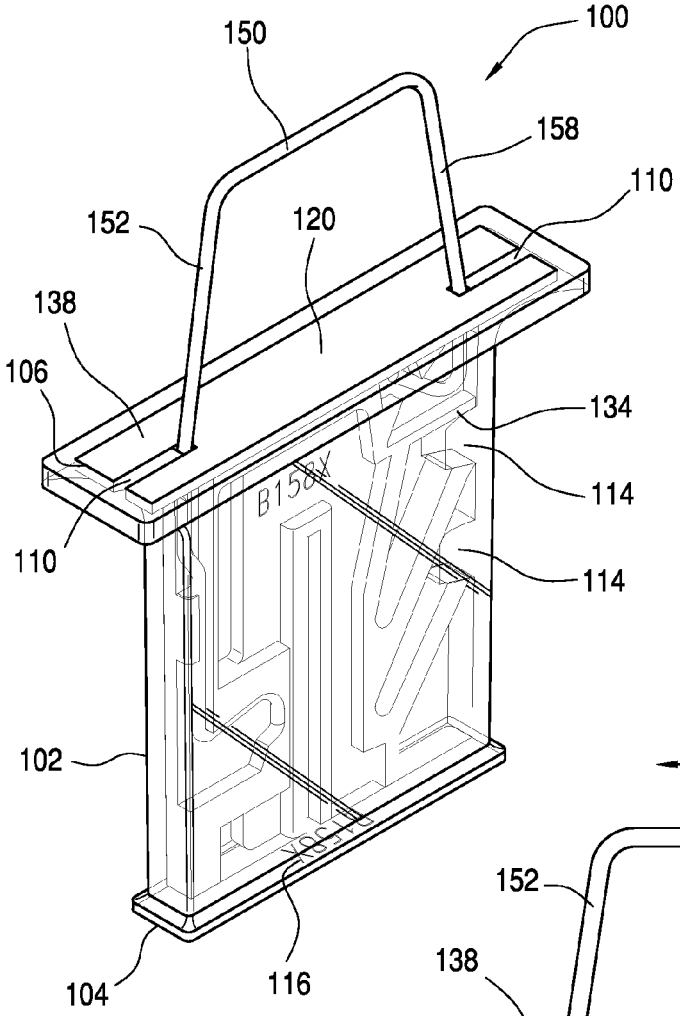
FIG. 1 is a perspective view of an embodiment of a security seal according to the present disclosure.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of a security seal and the components thereof, and in no way limit the structures or configurations of a security seal and components thereof according to the present disclosure.

DETAILED DESCRIPTION

A. Detailed Description of a First Embodiment of a Security Seal

Figure 3:
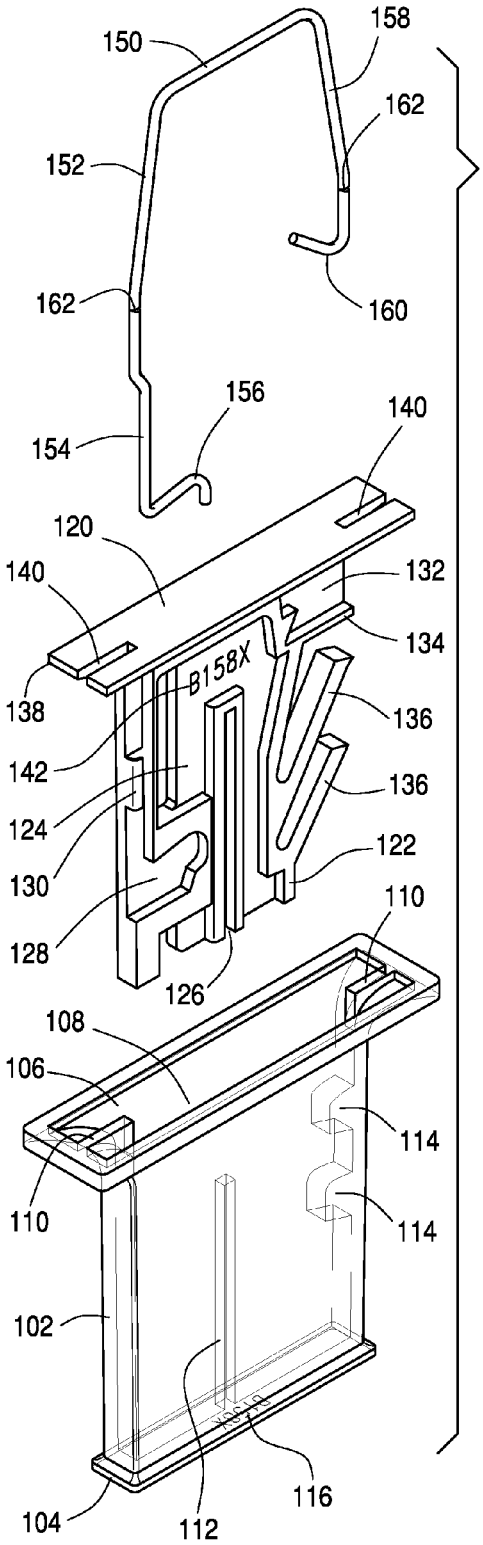
FIG. 3 is a perspective exploded view of the shackle, locking insert, and outer body of the security seal according to FIG. 1.

An embodiment of a security seal 100 according to the present disclosure is shown in FIGS. 1 and 3. The security seal 100 generally includes three components, an outer body 102, a locking insert 120, and a shackle 150.

As best seen in FIGS. 1, 2, 5, 6, and 9, the shackle 150 and locking insert 120 are assembled together and are received and retained within the outer body 102, in a manner to be more fully discussed below. Once the components of the security seal 100 are assembled, the configuration of the security seal 100 discourages tampering therewith, since the unauthorized disassembly thereof will provide clear indication of tampering with the security seal 100, as discussed more fully below.

Figure 2:
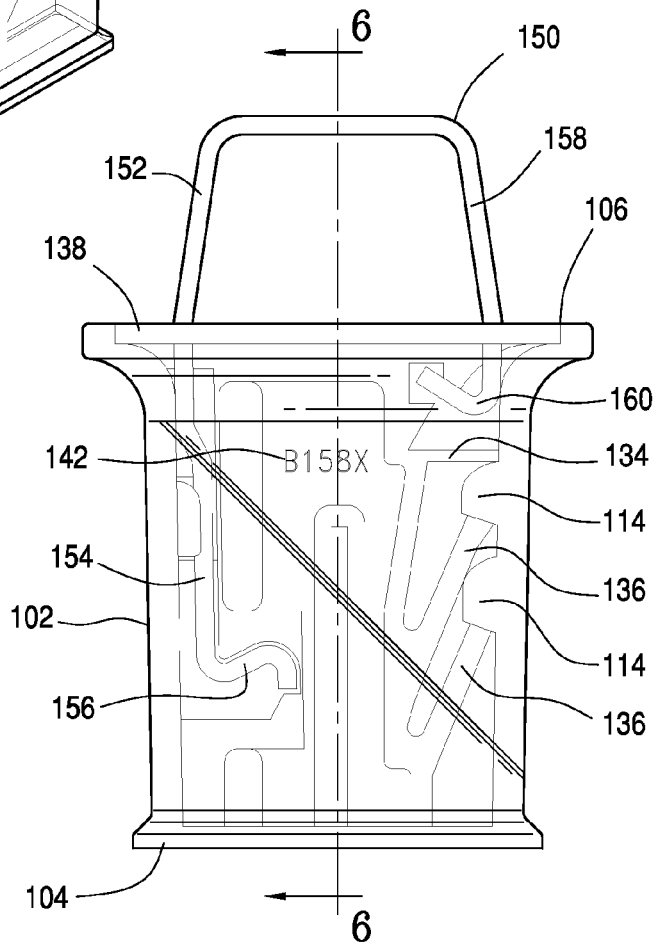
FIG. 2 is a front view of the security seal according to FIG. 1.
Figure 4:
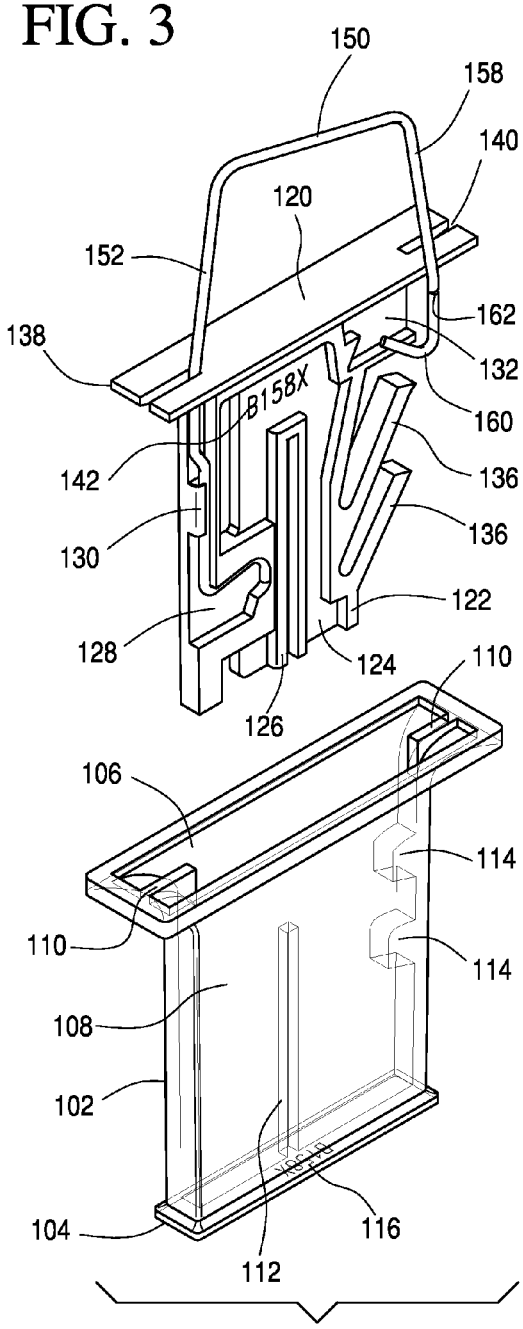
FIG. 4 is a perspective exploded view of the shackle assembled with the locking insert, and the outer body of the security seal according to FIG. 1.
Figure 5:
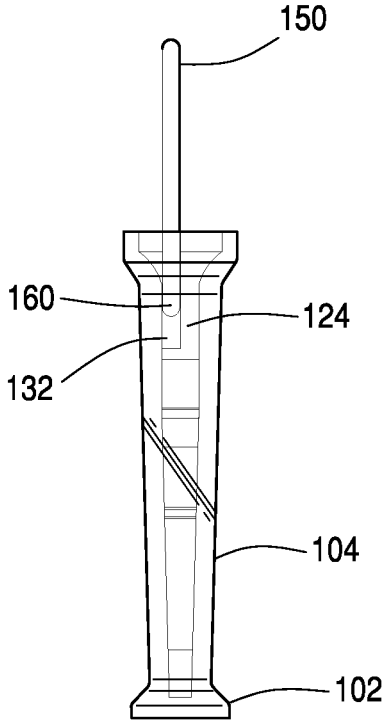
FIG. 5 is a side view of the security seal according to FIG. 1.

As best seen in FIGS. 2-4, the outer body 102 includes a base 104 at a first end thereof and a profiled opening 106 at a second end thereof, the profiled opening communicating with a cavity 108 having a bottom area defined within the outer body 102. In this manner, the outer body 102 is generally formed as a female part for receiving therein a male insert plug body 122 of the locking insert 120. The outer body 102 can be formed from any suitable material, such as metal or plastic. In the illustrated embodiment, the outer body 102 is formed of a transparent plastic material, so that any damage to the locking insert 120 or internal components of the outer body 102 can readily be discerned.

As can be seen in FIGS. 3 and 4, the cavity 108 includes structures configured to cooperate with the insert plug body 122 of the locking insert 120. In particular, a guide projection 112 is provided on an inner wall of the cavity 108.

Figure 6:
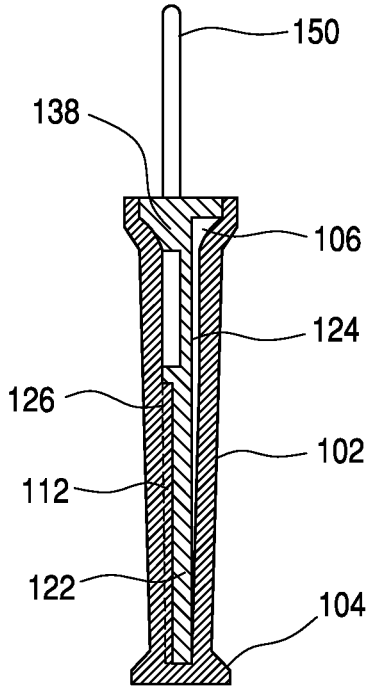
FIG. 6 is a cross-sectional view of the security seal according to FIG. 1, and taken along lines 6-6 of FIG. 2.
Figure 8:
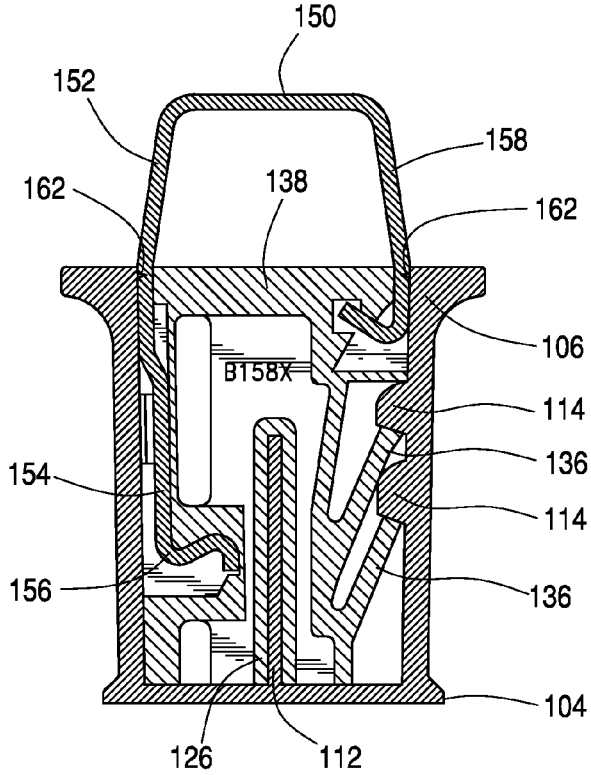
FIG. 8 is a cross-sectional view of the security seal according to FIG. 1, and taken along lines 8-8 of FIG. 7.
Figure 9:
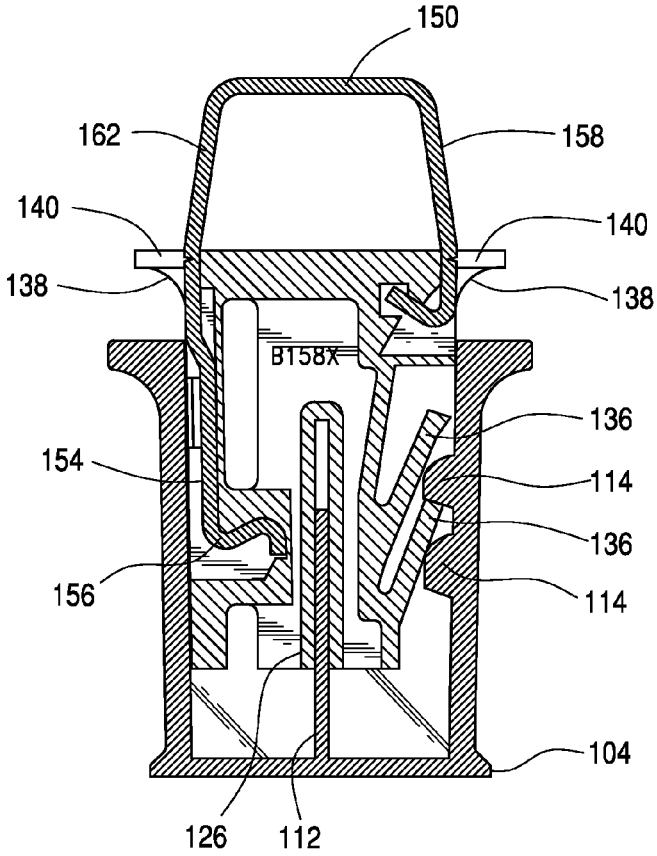
FIG. 9 is a cross-sectional view of the security seal according to FIG. 1, and taken along the same plane as lines 8-8 of FIG. 7, and showing the security seal in a partially assembled configuration.

As shown in FIGS. 6, 8, and 9, the guide projection 112 extends upwardly from the bottom area of the cavity, and cooperates with a guide slot 126 formed on the locking insert 120 to ensure that the locking insert 120 is properly aligned and engaged with the outer body 102 during and after insertion of the locking insert in the cavity.

Referring to FIGS. 3 and 4, the cavity 108 also includes locking abutments 114 formed along an inner side wall thereof for cooperating in a locking manner with respective locking fingers 136 formed on the locking insert 120.

As mentioned above, the outer body 102 includes a profiled opening 106, as best seen in FIGS. 3 and 4. The profiled opening 106 is complementary shaped to a correspondingly profiled insert cover 138 of the locking insert 120. In the exemplary embodiment, the profiled opening 106 can include shackle leg clearance closing tabs 110 that cooperate to fill in shackle leg clearances 140 in the profiled insert cover 138 of the locking insert 120 to eliminate gaps in the security seal where a tool may be inserted to tamper with the security seal (see FIGS. 1, 7, and 8). While there will be small clearance/tolerance gaps in the security seal to allow assembly thereof, there will be no gaps of a sufficient size to allow a tool to be inserted to tamper with the security seal.

As shown in FIGS. 2-6, the profiled opening 106 is also configured to help guide the insert plug body 122 of the locking insert 120 into the cavity 108 for ease of assembly of the security seal. In particular, the exemplary profiled opening 106 can include gradually curved edges at the top of the cavity 108 that are curved towards the inside of the cavity 108. Preferably, the insert plug body of the locking insert is configured so that it can be assembled with the outer body 102 in a single orientation only to ensure proper assembly.

As is also shown best in FIGS. 3 and 4, the outer body 102 includes some unique indicia, or a unique identification number 116. While the identification number 116 is shown positioned on the bottom of the base 104 of the outer body 102, the identification number or other indicia 116 can be provided in any suitable position on the outer body 102. While the identification number 116 is shown on the exterior of the outer body 102, if the outer body is formed of a transparent material, the identification number 116 can be formed inside the outer body 102 or even within the material of the outer body 102. The identification number 116 can be formed in any suitable manner, such as by being integrally molded with the outer body 102.

As shown in FIGS. 3 and 4, the identification number or indicia 116 corresponds to a matching unique identification number or indicia 142 formed on the locking insert 120. The identification number or indicia 142 formed on the locking insert 120 can be formed on any suitable area of the locking insert 120 that is received within the outer body 102. In this manner, the locking insert 120 and outer body 102 form a unique security seal 100, such that removal and replacement of one of the locking insert 120 and outer body 102 will provide indication of tampering therewith, due to a mismatch between the identification number or indicia 116 of the outer body 102 and the indicia 142 formed on the locking insert 120.

The structure of the locking insert 120 is further shown in FIGS. 8 and 9, as well as FIGS. 1-4. The locking insert 120 can be formed from any suitable materials, such as, for example, metal or plastic. The locking insert 120 includes a male insert plug body 122 that is defined by an insert plug body rear wall 124. A number of structures, discussed in detail below, are formed on the insert plug body rear wall 124.

In particular, a first shackle hook receiver 128 and a shackle leg offset portion retainer 130 are positioned along a first side of the insert plug body 122 and are formed as projecting portions from the insert plug body rear wall 124. The first shackle hook receiver 128 and the shackle leg offset portion retainer 130 cooperate with a first shackle hook 156 and an offset portion 154 of a first shackle leg 152 to allow the shackle 150 to be engaged with the locking insert 120.

The male insert plug body 122 also includes a second shackle hook receiver 132, an insert bulkhead or wall 134 located just below and aligned with the receiver 132, and locking fingers 136 formed along a second side of the insert plug body 122 and formed as projecting portions from the insert plug body rear wall 124. The second shackle hook receiver 132 cooperates with a second shackle hook 160 of a second shackle leg 158 to allow the shackle 150 to be engaged with the locking insert 120.

The male insert plug body 122 also includes a guide slot 126 formed from projections extending from the insert plug body rear wall 124. The guide slot 126 extends from the distal or lower end of the insert plug body 122 towards the upper portion or insert cover 138 of the insert plug body 122. The insert plug body rear wall 124 is slightly offset from the center of the male insert plug body 122, such that the male insert plug body 122 can only be inserted into the cavity 108 of the outer body 102 if the guide slot 126 is aligned with the guide projection 112. In this manner, the locking insert 120 can only be inserted into the cavity 108 of the outer body 102 in one way, with the guide slot 126 aligned with the guide projection 112. If the male insert plug body 122 is rotated 180 degrees, the insert plug body rear wall 124 will contact the guide projection 112 to prevent the insertion of the insert plug body 122 into the cavity 108 of the outer body 102. The projection 112 and guide slot 126 extend between the position of the shackle legs 152, 158 when the locking insert and shackle legs are inserted in the cavity 108.

As shown in FIGS. 2, 8, and 9, the locking fingers 136 positioned along the second side of the insert plug body rear wall 124 cooperate with the locking abutments 114 formed along the inner side wall of the cavity 108 of the outer body 102 to prevent the removal of the locking insert 120 from the outer body 102 without damage once the locking insert 120 is engaged with the outer body 102. As can be seen, the locking fingers 136 are formed at an angle to the insert plug body 122, and are resilient, so that the locking fingers 136 pass over the locking abutments 114 when the male insert plug body 122 is inserted into the cavity 108 of the outer body 102. Once the locking fingers 136 have passed over the locking abutments 114, the ends of the locking fingers 136 abut against the locking abutments 114 to prevent the withdrawal of the locking insert 120 from the outer body 102 without damage to the security seal 100.

The upper portion of the locking insert 120 is formed into a profiled insert cover 138 that is complementary shaped to the profiled opening 106 of the outer body 102. The profiled insert cover 138 can include gradually curved surfaces that mate with the curved surfaces of the profiled opening 106 so that the locking insert 120 seats within the cavity 108 of the outer body 102, like a drawer. The locking insert 120 thus is received in a flush manner within the cavity 108 of the outer body 102.

Figure 7:
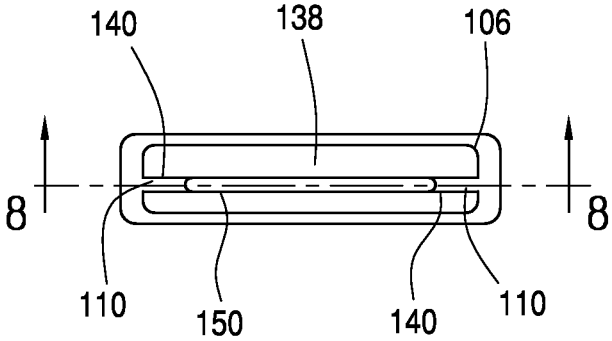
FIG. 7 is a top view of the security seal according to FIG. 1.

The profiled insert cover 138 includes shackle leg clearances 140 that allow the first and second shackle legs 152, 158 to be assembled with and to pass through the insert cover 138 into the insert plug body 122 along the insert plug body rear wall 124. As shown in FIGS. 1 and 7, when the security seal 100 is assembled in a locking position, and the shackle legs 152, 158 are retained between outer body 102 and the locking insert 120, the shackle leg clearance closing tabs 110 cooperate with the shackle leg clearances 140 such that there are no exterior gaps (larger than necessary clearance/tolerance gaps for assembly thereof) between the shackle legs 152, 158 and the outer body 102 and the locking insert 120. In this manner, the security seal 100 is configured to prevent the insertion of a tool into the security seal, thus discouraging tampering. Further, if a tool is used to attempt to remove the shackle 150, since there are no gaps (other than clearance/tolerance gaps) for the insertion of a tool, either the outer body 102 or the locking insert 120 will show evidence (damage, such as scratches or gouges) of the tool insertion.

Additionally, if someone attempts to remove the second shackle leg 158, for example with acid, the insert bulkhead 134 prevents the insertion of a tool into the cavity 108 of the outer body 102 to manipulate the locking fingers 136. Thus, even if the shackle 150 is removed, the locking insert 120 cannot be removed from the cavity 108 of the outer body 102 without causing damage to either the locking insert 120 or the outer body 102.

As shown in the Figures, and in particular FIGS. 3, 8, and 9, and as substantially described above, the shackle 150 has a generally truncated U-shaped configuration with first and second laterally spaced shackle legs 152, 158 extending therefrom. The first shackle leg 152 also includes an offset portion 154 at the end thereof for insertion into the insert plug body 122. While the shackle 150 is shown having a generally truncated U-shaped configuration, it will be recognized that any suitable shape can be utilized. The shackle 150 can be formed from any suitable material, such as a metal wire. Exemplary metals can include any steel or aluminum alloy.

As already mentioned above, the first and second shackle legs 152, 158 each have respective first and second shackle hooks 156, 160 formed at the distal ends thereof. The first and second shackle legs 152, 158, or at least one of the shackle legs, also each have pre-weakened zones 162 formed therein.

As shown in FIG. 8, when the security seal is assembled, the pre-weakened zone or zones 162 are positioned within the body of the security seal 100 so as to be hidden from view. If attempts are made to bend the shackle 150, the pre-weakened zones 162 will either cause the shackle 150 to break, and thus indicate tampering, or the shackle legs 152, 158 will permanently deform at the pre-weakened zones 162, and thus indicate tampering.

Turning back to FIGS. 3, 4, and 8, the security seal 100 can be shipped or provided in a disassembled, or in a partially assembled manner. As shown in FIG. 4, the first shackle hook 156 can be inserted into the first shackle hook receiver 128 and the offset portion 154 of the first shackle leg 152 is retained by the shackle leg offset portion retainer 130. The shackle leg offset portion retainer 130 is configured to allow the offset portion 154 of the first shackle leg 152 to rotate therein so that the second shackle hook 160 can be positioned outside of the shackle leg clearance 140 in the insert cover 138. In this manner, the locking insert 120 can be prevented from accidental engagement with the outer body 102.

When it is desired to further assemble the security seal 100, as shown in FIG. 9, the second shackle hook 160 can be secured within the second shackle hook receiver 132. Then, the locking insert 120 can be inserted into the cavity 108 of the outer body 102 until one of the locking fingers 136 passes over and abuts with the first locking abutment 114. In this configuration, the second shackle hook 160 can be removed from within the second shackle hook receiver 132 to allow the shackle to be connected to the meter, receptacle, or other device.

Once the shackle has been secured to the device, the second shackle hook 160 can again be secured within the second shackle hook receiver 132, and the locking insert 120 fully inserted into the cavity 108 of the outer body 102 until both locking fingers 136 have passed over and abut the locking abutments 114, as shown in FIG. 8.

As previously discussed, once the locking insert 120 is fully inserted into the cavity 108 of the outer body 102, the locking fingers 136 and locking abutments 114 cooperate to prevent the removal of the locking insert 120 from the cavity 108, without causing damage to the security seal 100.

Further, since there are no gaps, other than the necessary clearance/tolerance gaps, between the shackle legs 152, 158 and the outer body 102 and the locking insert 120, a tool cannot be used to remove the shackle 150 without causing damage to the security seal 100.

Even further still, even if the shackle 150 is removed, the insert bulkhead 134 prevents the locking insert 120 from being removed from the cavity 108 of the outer body 102 without causing damage to either the locking insert 120 or the outer body 102.

Still further, even if the locking insert 120 is removed from the cavity 108 of the outer body 102, without causing damage to the outer body, there will inherently be damage to the locking insert 120. However, the matching indicia or identification numbers 116, 142 on the outer body 102 and the locking insert 120 prevent the simple replacement of the damaged locking insert 120 with a new locking insert.

Even further still, the pre-weakened zones 162 in the shackle legs 152, 158 will show evidence of tampering via breakage or permanent deformation if the shackle 150 is bent. In other words, the shackle 150 cannot first be bent from the original configuration and then be bent back into the original configuration, since pre-weakened zones 162 in the shackle legs 152, 158 will show evidence of tampering via breakage or permanent deformation thereof.

B. Detailed Description of a Second Embodiment of a Security Seal

Figure 10:
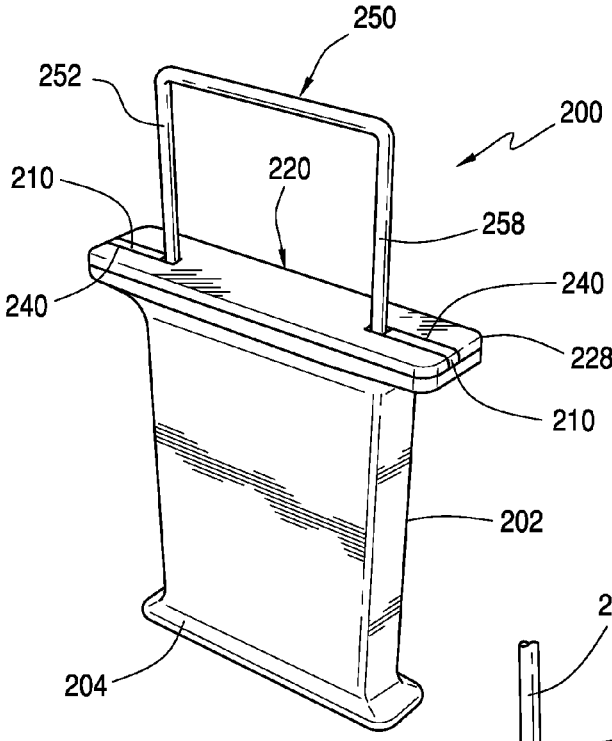
FIG. 10 is a perspective view of another embodiment of a security seal according to the present disclosure.
Figure 11:
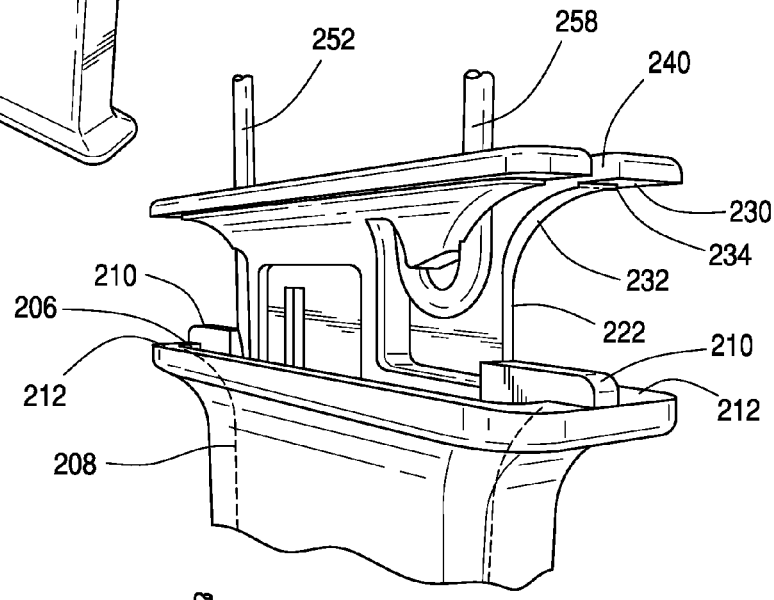
FIG. 11 is a front perspective view of the security seal according to FIG. 10 shown in a partially assembled configuration.

Another embodiment of a security seal 200 in accordance with the present disclosure is shown in FIGS. 10 and 11. The features of this embodiment of a security seal 200 are substantially similar to the embodiment discussed above.

In particular, like security seal 100, the security seal 200 generally includes three components, an outer body 202, a locking insert 220, and a shackle 250, which may have any desired shape, but is shown having a generally rectangular U-shape. The security seal 200 can include all of the security features discussed above, including transparent components and unique identification number or indicia. Further, the assembly of the security seal 200, including the internal components formed on the locking insert 220 and the internal features of the outer body 202, such as guide slots, locking fingers, guide projections, and locking abutments, are the same as discussed above with respect to the security seal 100, and these features are not further discussed here.

Like the security seal 100, the outer body 202 of the security seal 200 includes a base 204, and a profiled opening 206 leading into a cavity 208, which generally forms a female portion of the security seal 200. As with security seal 100, a guide projection and locking abutments can be formed within the cavity 208.

Figure 12:
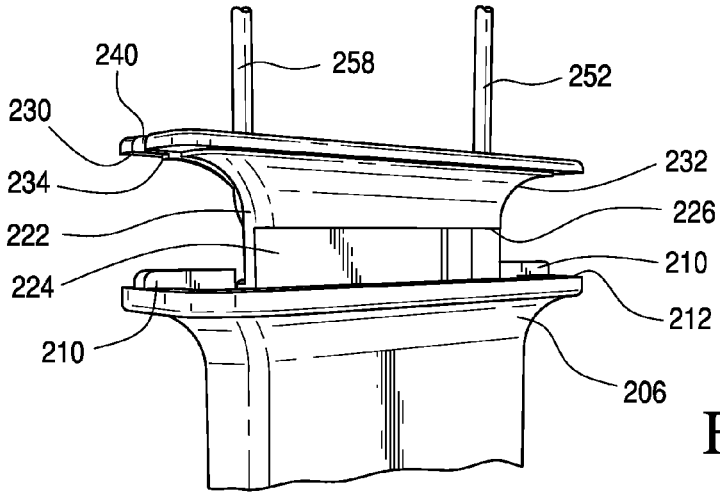
FIG. 12 is a rear perspective view of the security seal according to FIG. 10 shown in a partially assembled configuration.

As best seen in FIGS. 11 and 12, a mating surface 212 is formed at the top portion of the outer body 202 around the periphery of the profiled opening 206. At opposed sides of the profiled opening 206 shackle leg clearance closing tabs 210 extend partially into the profiled opening 206, as well as above the mating surface 212 in order to form projecting portions. As discussed in more detail below, the shackle leg clearance closing tabs 210 are configured to eliminate gaps in the assembled security seal 200 (other than clearance/tolerance gaps).

As seen in FIGS. 10-12, the locking insert 220 (generally forming a male portion of the security seal 200) includes an insert plug body 222 generally formed as previously discussed with respect to the insert plug body 122, including features such as a guide slot, first and second shackle hook receivers, insert bulkhead, and locking fingers.

As can be seen in FIG. 12, the insert plug body 222 includes an insert plug body rear wall 224, which may include a rear wall ledge 226. The rear wall ledge 226 may cooperate with a projection within the cavity 208 in order to aid with limiting the extent that the insert plug body 222 is inserted into the cavity 208, and can provide an additional mechanism to prevent the insertion of a tool within the cavity by eliminating any gap between the insert plug body 222 and the inner wall of the cavity 208.

As best seen in FIGS. 11 and 12, the insert plug body 222 also includes an insert cover/cap portion 228. The cap portion 228 has a mating surface 230 on the underside thereof, which, when the insert plug body 222 is inserted into the cavity 208 of the outer body 202 closely mates with the mating surface 212 of the outer body 202 (FIG. 12) in order to prevent the insertion of any tool within the cavity 208.

Located beneath the mating surface 230 is a profiled portion 232 that is complementary shaped to the profiled opening 206 leading into the cavity 208 of the outer body 202. The profiled portion 232 may include a separation edge 234 formed between the profiled portion 232 and the mating surface 230, which edge may be generally perpendicularly oriented with respect to the mating surface 230. In the drawings, this separation edge 234 is shown in an exaggerated size in order to better illustrate the edge 234. The edge 234 may also be generally sloped, as opposed to perpendicularly oriented, in order to provide a cleaner transition between the mating surface 230 and the profiled portion 232, or in an alternative configuration, there may be no separation edge provided between the mating surface 230 and the profiled portion 232, such that the profiled portion 232 is generally contiguously formed extending from the mating surface 230.

As can be seen in FIG. 10, shackle leg clearances or slots 240 are provided in the cap portion 228 to accommodate the first and second shackle legs 252, 258. When the locking insert 220 is assembled with the outer body 202 of the security seal, the first and second shackle legs 252, 258 are positioned within the shackle leg clearances 240, which clearances are then closed off by the shackle leg clearance closing tabs 210, which project above the mating surface 212. Thus, when the security seal 200 is assembled, there are no exterior gaps (larger than necessary clearance/tolerance gaps for assembly thereof) between the shackle legs 252, 258 and the outer body 202 and the locking insert 220. In this manner, the security seal 200 is configured to prevent the insertion of a tool into the security seal, thus discouraging tampering.

With this configuration of the embodiment of the security seal 200 shown in FIGS. 10-12, and in particular, the complimentary shapes of the profiled opening 206, the profiled portion 232, the separation edge 234, and the mating surfaces 212, 230, it is very difficult to insert a tool between the locking insert 220 and the outer body 202 of the security seal 200. Additionally, even if a tool is able to be inserted between the mating surface 212 of the outer body 202 and the mating surface 230 of the cap portion 228, because of the separation edge 234 and profiled portion 232, and further due to the close fit between the complementary shaped profile portion 232 and profiled opening 206, it is extremely difficult to insert a tool beyond the separation edge 234 and into the internal cavity 208 of the outer body 202 of the security seal 200.

Thus, and in particular in view of the internal configuration of the security seal 200, as described above in detail with respect to the security seal 100, even if a tool were inserted between the locking insert 220 and the outer body 202 of the security seal 200, the two pieces cannot be separated from each other without damage to one or both pieces, which damage will be visually detectable. Similarly, if acid is used to dissolve the shackle legs 252, 258, a new shackle cannot be inserted without disassembling the locking insert 220 from the outer body 202 of the security seal 200, which as previously discussed, will damage one or both of the locking insert 220 and the outer body 202.

Therefore, it can be seen that the embodiments of the security seals 100, 200 described herein provide improved security seals to prevent tampering.

C. Conclusion

It will be recognized that the security seals described herein are appropriately sized so as to be manipulated by hand, and may even be manipulated using a single hand. However, it is understood that the size of the disclosed embodiments and the components thereof can be adjusted within the scope of the present disclosure.

It is also understood that the locations of various structural features may be altered from the positions as illustrated herein. In particular, the position of the guide groove and guide slot can be alternated.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various disclosed features from the disclosed embodiments and variations. In addition to any variations described herein, other known equivalents for each feature can be mixed and matched by one of ordinary skill in this art to construct a security seal in accordance with principles of the present invention.

Although this invention has been disclosed in the context of exemplary embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. A security seal comprising:

an outer body having a cavity that includes a bottom area;

a locking insert configured to be assembled with the outer body by being inserted in the cavity and permanently secured therein against removal by at least one locking finger carried by the insert that is configured to pass over and engage at least one locking abutment formed in the cavity when the insert is inserted in the cavity with the security seal in order to prevent the removal thereof from the cavity; and a shackle having laterally spaced shackle legs configured to be carried by the locking insert for insertion in the cavity with the locking insert and with the locking insert permanently secured in the cavity against removal;

wherein a guide projection is provided on an inner wall of the cavity extending upwardly from the bottom area of the cavity and a guide slot is provided on the locking insert that engages and cooperates with the guide projection to align the locking insert with the outer body during and after insertion of the locking insert in the cavity.

2. The security seal according to claim 1, wherein the locking insert includes a cover including shackle leg openings through which the shackle legs extend upon assembly of the shackle and locking insert; the outer body has a body opening providing access to the cavity and which is closed by the cover when the locking insert, shackle legs and outer body are assembled in a sealing position, said cover, shackle legs, shackle leg openings and body opening having complementary shapes that result in all exterior gaps providing access to the outer body cavity being closed when said locking insert, shackle legs, and outer body are assembled in a sealing position with the locking insert and shackle legs within the cavity.

3. The security seal according to claim 2, wherein when the security seal is assembled with the locking insert within the cavity, the locking insert cover sits flushly within the body opening of the outer body.

4. The security seal according to claim 2, wherein the insert cover includes a cap portion having a mating surface along an underside thereof, such that when the security seal is assembled with the locking insert within the cavity, the mating surface of the locking insert cover mates with a mating surface defined around a periphery of the body opening of the cavity.

5. The security seal according to claim 1, wherein the locking insert includes a shackle leg receiving and securing element for a shackle leg beneath the locking insert cover when the locking insert is within the cavity in a sealing position, and a bulkhead extending beneath the shackle leg receiving element blocking any direct access path between the shackle opening for the respective shackle leg in the locking insert cover and the interior of the outer body below the bulkhead.

6. The security seal according to claim 1, wherein said locking insert and outer body are provided with a matching unique identifier.

7. The security seal according to claim 1, wherein said guide projection and guide slot extend between said shackle legs when the locking insert and shackle legs are fully inserted into the cavity.

8. The security seal according to claim 1, said outer body, locking insert and shackle legs being configured such that when assembled together in a sealing position no exterior gaps providing access to the outer body cavity are presented between them.

9. The security seal according to claim 1, said guide projection and guide slot being configured in an offset manner relative to the outer body and locking insert, respectively, such that the locking insert may only be received fully in the cavity one way.

10. A security seal comprising:

an outer body having a body opening leading into a cavity, said cavity having a bottom area;

a locking insert configured to be assembled to the outer body by being inserted in the cavity through the body opening and permanently secured therein against removal by at least one locking finger carried by the insert and configured to pass over and engage at least one locking abutment formed in the cavity when the insert is assembled with the security seal in order to prevent the disassembly thereof;

a shackle having at least two laterally spaced shackle legs configured to be carried by the locking insert for insertion in the cavity with the locking insert and permanently secured therein against removal;

wherein the locking insert includes a cover including shackle leg openings through which the shackle legs extend when carried by the locking insert, and the body opening is closed by the cover when the locking insert, shackle legs and outer body are assembled in a sealing position, said cover, shackle legs, shackle leg openings and body opening having complementary shapes that result in all exterior gaps providing access to the outer body cavity when said locking insert, shackle legs, and outer body are assembled in a sealing position being closed;

wherein the locking insert includes two shackle leg receiving and securing elements for two shackle legs beneath the locking insert cover when the locking insert is inserted in the cavity in a locking position and a bulkhead extending beneath one of the shackle leg receiving elements blocking any direct access path between the shackle opening for the respective shackle leg in the locking insert cover and the interior of the outer body below the bulkhead, said bulkhead being carried by the insert and disposed between the locking insert cover and said at least one locking abutment when the insert is fully inserted into the cavity.

11. The security seal according to claim 10, wherein when the security seal is assembled with the locking insert fully inserted in the cavity, the locking insert cover sits flushly within the body opening of the cavity of the outer body.

12. The security seal according to claim 10, wherein the insert cover includes a cap portion having a mating surface along an underside thereof, such that when the security seal is assembled with the locking insert fully inserted in the cavity, the mating surface of the locking insert cover mates with a mating surface defined around a periphery of the body opening of the cavity.

13. The security seal according to claim 10, wherein a guide projection is provided on an inner wall of the cavity extending upwardly from the bottom area of the cavity between the positions of the shackle legs when the locking insert and shackle legs are inserted in the cavity and a guide slot is provided on the locking insert that engages and cooperates with the guide projection to align the locking insert with the outer body during and after insertion of the locking insert in the cavity.

14. The security seal according to claim 13, said guide projection and guide slot being configured in an offset manner relative to the outer body and locking insert, respectively, such that the locking insert may only be received fully in the cavity one way.

15. The security seal according to claim 10, wherein said locking insert and outer body are provided with a matching unique identifier.

16. The security seal according to claim 10, wherein the cover of the locking insert includes shackle openings through which the shackle legs extend upon assembly of the shackle and locking insert, and the outer body includes closing tabs that cooperate to fill in the shackle openings when the locking insert is fully inserted in the cavity.

17. A security seal comprising:

an outer body having a body opening leading into a cavity, the cavity having a bottom area;

a locking insert configured to be assembled to the outer body by being inserted in the cavity through the body opening in the cavity and permanently secured therein against removal; and a shackle having two laterally spaced shackle legs configured to be carried by the locking insert for insertion in the cavity with the locking insert when the insert is inserted in the cavity and permanently secured therein against removal with the locking insert;

wherein the locking insert includes a cover including shackle openings through which the shackle legs extend upon assembly of the shackle and locking insert, and the body opening is closed by the cover when the locking insert, shackle legs and outer body are inserted in the cavity, said cover, shackle legs, shackle openings and body opening having complementary shapes that result in all exterior gaps providing access to the outer body cavity when said locking insert, shackle legs, and outer body are assembled in a sealing position with the locking insert fully in the cavity being closed; and wherein the cover of the locking insert includes shackle openings through which the shackle legs extend upon assembly of the shackle and locking insert before the locking insert is fully inserted in the cavity, and the outer body includes closing tabs that cooperate to fill in any remaining shackle openings when the locking insert with the shackle legs are fully inserted in the cavity;

wherein a guide projection is provided on an inner wall of the cavity extending upwardly from the bottom area of the cavity between the positions of the shackle legs when the locking insert and shackle legs are inserted in the cavity and a guide slot is provided on the locking insert that engages and cooperates with the guide projection to align the locking insert with the outer body during and after insertion of the locking insert in the cavity.

18. The security seal according to claim 17, wherein when the locking insert is fully inserted in the cavity, the locking insert cover sits flushly within the body opening of the cavity of the outer body.

19. The security seal according to claim 17, wherein the insert cover includes a cap portion having a mating surface along an underside thereof, such that when the locking insert is fully inserted in the cavity, the mating surface of the locking insert cover mates with a mating surface defined around a periphery of the body opening of the cavity.

20. The security seal according to claim 17, said guide projection and guide slot being configured in an offset manner relative to the outer body and locking insert, respectively, such that the locking insert may only be received fully in the cavity one way.

21. A security seal comprising:

an outer body having a cavity that includes a bottom area;

a locking insert configured to carry a shackle having shackle legs and to be assembled with the outer body by being inserted in the cavity with the shackle legs and permanently secured therein against removal by at least one locking finger carried by the insert that is configured to pass over and engage at least one locking abutment formed in the cavity when the insert is inserted in the cavity with the security seal in order to prevent the removal thereof from the cavity; and a guide projection provided on an inner wall of the cavity extending upwardly from the bottom area of the cavity and a guide slot provided on the locking insert that engages and cooperates with the guide projection to align the locking insert with the outer body during and after insertion of the locking insert in the cavity.

22. The security seal according to claim 21, said guide projection and guide slot being configured in an offset manner relative to the outer body and locking insert, respectively, such that the locking insert may only be received fully in the cavity one way.

* * * * *